US006224164B1

(12) United States Patent
Hall et al.

(10) Patent No.: US 6,224,164 B1
(45) Date of Patent: May 1, 2001

(54) MINING MACHINE WITH DETACHABLE ARTICULATED CUTTING ASSEMBLY

(75) Inventors: Kevin R. Hall, Franklin; Gregory S. Wilson, Oil City; John R. Frederick, Polk, all of PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 09/249,913

(22) Filed: Feb. 12, 1999

(51) Int. Cl.[7] ..... E21C 27/00; E21C 35/04

(52) U.S. Cl. ..... 299/75; 299/33; 299/64; 299/76; 299/78

(58) Field of Search ..... 299/64, 75, 76, 299/78, 33

(56) References Cited

U.S. PATENT DOCUMENTS

| | | | | |
|---|---|---|---|---|
| 2,788,202 | * | 4/1957 | Barrett | 299/76 |
| 3,516,712 | * | 6/1970 | Bennett | 299/78 |
| 3,929,378 | * | 12/1975 | Frenyo et al. | 299/76 |
| 3,966,258 | * | 6/1976 | Dolecki | 299/76 |
| 4,362,337 | | 12/1982 | Casanova . | |
| 4,655,507 | * | 4/1987 | Wechner | 299/33 |
| 4,785,560 | * | 11/1988 | Hanson | 299/76 |
| 4,884,848 | | 12/1989 | Wrulich et al. . | |
| 4,953,914 | | 9/1990 | LeBegue . | |

FOREIGN PATENT DOCUMENTS

| | | | | |
|---|---|---|---|---|
| 2300605 | * | 7/1974 | (DE) | 299/75 |
| 2447604 | * | 4/1976 | (DE) | 299/75 |
| 1 501 490 | | 2/1978 | (GB) . | |
| 2 152 978 | | 8/1985 | (GB) . | |
| 2 163 797 | | 3/1986 | (GB) . | |
| 516815 | * | 2/1974 | (SU) | 299/75 |
| 1153058 | * | 4/1985 | (SU) | 299/76 |

OTHER PUBLICATIONS

Super Roc–Miner Brochure; Alpine Equipment, 1978 6 pages.*

Bobcat and Bob–tach Brochure; Melroe Corp., undated 8 pages.*

* cited by examiner

*Primary Examiner*—David Bagnell
*Assistant Examiner*—John Kreck
(74) *Attorney, Agent, or Firm*—Thomas J. Edgington; James Earl Lowe, Jr.

(57) ABSTRACT

A mining machine that has a chassis that defines an operator area thereon and has a mining assembly attached thereto. A vertically extending shield assembly is supported on the chassis to prevent material that is dislodged during the mining process from inadvertently entering the operator area. The shield assembly may be selectively vertically extendable and may be equipped with a ventilation duct assembly to withdraw dust and gases away from the operator area. The mining machine may be equipped with a mining assembly that extends the entire width of the chassis and that can be advanced forwardly of the chassis and swung down across the seam face during mining. The present invention may also be equipped with a quick disconnect assembly for detachably mounting the mining assembly or other mining implement to the mining machine.

23 Claims, 14 Drawing Sheets

MINING MACHINE WITH DETACHABLE ARTICULATED CUTTING ASSEMBLY

CROSS-REFERENCE TO RELATED APPLICATIONS

Not applicable.

FEDERALLY SPONSORED RESEARCH

Not applicable.

BACKGROUND OF THE INVENTION

FIELD OF THE INVENTION

The subject invention relates to apparatuses for mining materials from underground seams and, more particularly, to mining machines and detachable mining assemblies for attachment to mobile vehicles.

DESCRIPTION OF THE INVENTION BACKGROUND

A variety of methods exist for mining coal and other materials form underground seams. One apparatus which is commonly employed in underground mining operations comprises a continuous mining machine which includes a rotatable cutting drum that is mounted on the front end of the mining machine. As the mining machine is advanced into the seam, the cutting drum dislodges or "wins" the coal from the seam, In some continuous miners of this type, the won material is conveyed rearwardly of the cutter drum by a longitudinally extending conveyor that may discharge into shuttle cars or other mobile conveying apparatuses to transport the won material from the mine face. The continuous mining machine continuously advances into the seam and, as the material is won therefrom, an entry or tunnel is formed in the seam.

Most underground mining machines are either controlled by an operator located remote from the mine face or by an operator that drives the machine from a seat or position provided thereon. In such operator occupied machines, the operator(s) is afforded little or no room to move about when servicing and controlling various machine components. In addition, during the mining process, pieces of mined material are often thrown rearwardly onto the mining machine by the cutting heads as they are advanced into the seam. Such flying debris presents a hazard to the operator(s) located on the machine. Also during the mining process, a considerable amount of dust is usually generated in the area of the cutting heads. Such dust, along with methane and other gases represents other hazards to the operator(s) on the mining machine.

Another shortcoming often encountered with prior machines is associated with the dedicated cutting assembly that is permanently affixed to the machine. Such dedicated cutting apparatuses cannot be easily detached from the vehicle portion of the machine, should the unit be damaged or another type of mining unit be desired.

Thus, there is a need for a mining machine that affords additional room for an operator or operators to safely move about the machine when servicing and controlling machine components.

Another need exists for a mining machine that is equipped with a protective shield arrangement to protect the operators from flying debris, harmful dust and gases during the mining process.

Still another need exists for a mining machine that is equipped with apparatus for safely isolating and evacuating dust and gases that are generated and encountered during the mining process.

There is a further need for various mining assemblies that can be readily detached and attached to the mining machine chassis.

There is still another need for a quick disconnect assembly for facilitating removable attachment of mining assemblies to mining machines and the like.

SUMMARY OF THE INVENTION

In accordance with a particularly preferred form of the present invention, there is provided a mining machine that includes a chassis that has a width and a cutting mechanism that has a cutting width that is greater than the chassis width. The mining machine further includes an actuation assembly that is affixed to the chassis and the cutting mechanism for selectively moving the cutting mechanism forward of the chassis and down across a surface to be mined and retracted to gather and load cut material into the conveyor mechanism.

The present invention may also comprise a detachable mining apparatus for selective attachment to the chassis of a mining machine, The detachable mining apparatus includes a cutting mechanism that has a cutting width that is greater than the width of the mining machine chassis and an actuation assembly that is removably attachable to the chassis and the cutting mechanism for selectively moving the cutting mechanism forward of the frame and down across a surface to be mined and retracted toward the frame.

Another embodiment of the present invention comprises a quick disconnect assembly is for attaching an accessory to the chassis of an apparatus. The quick disconnect assembly includes a first member affixable to the accessory. The first member has at least one lug member protruding therefrom that has a hole extending therethrough, The assembly also includes a second member that is attachable to the chassis and has a cavity therein that corresponds to each lug member. Each cavity is sized to receive a corresponding lug member therein. The second member has an attachment hole corresponding to each cavity that is in coaxial alignment with the hole in the lug member received therein. A pin assembly corresponding to each attachment hole is adapted to selectively pass therethrough into the hole in the corresponding lug member to affix the second member to the first member.

It is a feature of the present invention to provide a mining machine that has a protective shield for preventing pieces of mined material from being inadvertently thrown by the mining assembly into the operator area of the machine.

It is another feature of the present invention to provide a vertically and laterally extending shield assembly that can be affixed to a mining machine chassis to prevent pieces of mined material from being thrown by the mining assembly to the operator side of the field.

Another feature of the present invention is to provide a shield having the above characteristics and that can isolate and assist with evacuation of dust and gases encountered during the mining process from entering the operator area of the machine.

Still another feature of the present invention is to provide a mining assembly that extends across the face of the machine and which is movable forward, down across and back from the surface to be mined to provide a square roof which can be better supported and bolted.

It is another feature of the present invention to provide a mining apparatus that has reach capabilities that enables the mining machine to remain stationary as a portion of the seam is mined and thereafter be advanced when necessary to bring the mining assembly in contact with the seam.

Another feature of the present invention is to provide a mining machine that affords a safe area for an operator to move about within the confines of the machine chassis to facilitate operation and maintenance of machine components.

Yet another feature of the present invention is to provide a quick disconnect assembly to facilitate quick attachment and detachment of a cutting, loading, gathering or other accessory to a chassis.

Accordingly, the present invention provides additional advantages over prior mining machines. Those of ordinary skill in the art will readily appreciate, however, that these and other details, features and advantages will become further apparent as the following detailed descriptions of the preferred embodiments proceed.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION OF THE PREFERRED EMBODIMENTS

Figure 1:
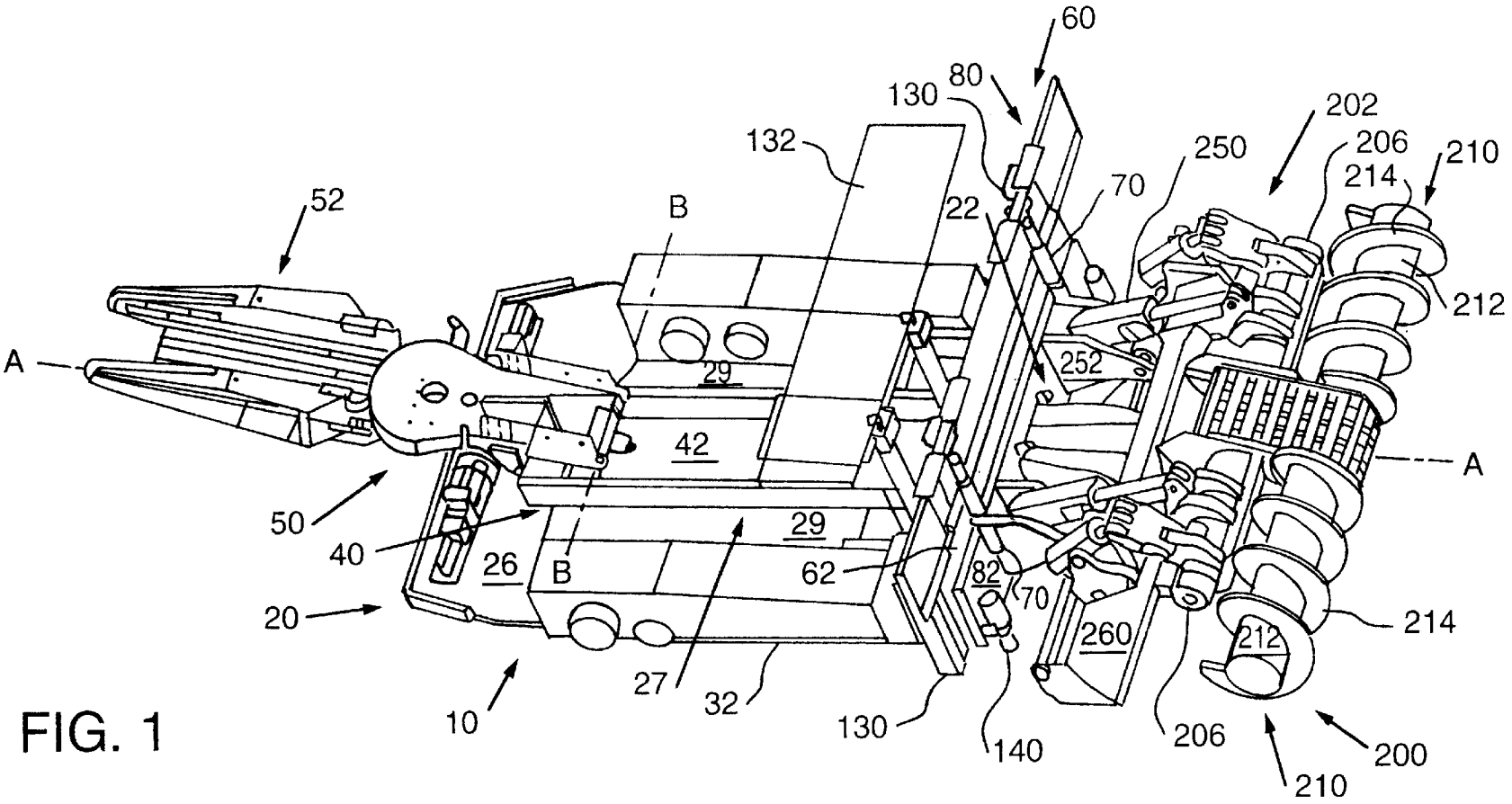
FIG. 1 is a perspective view of a mining machine of the present invention employing a vertically and laterally extending shield and detachable mining assembly of the present invention.
Figure 2:
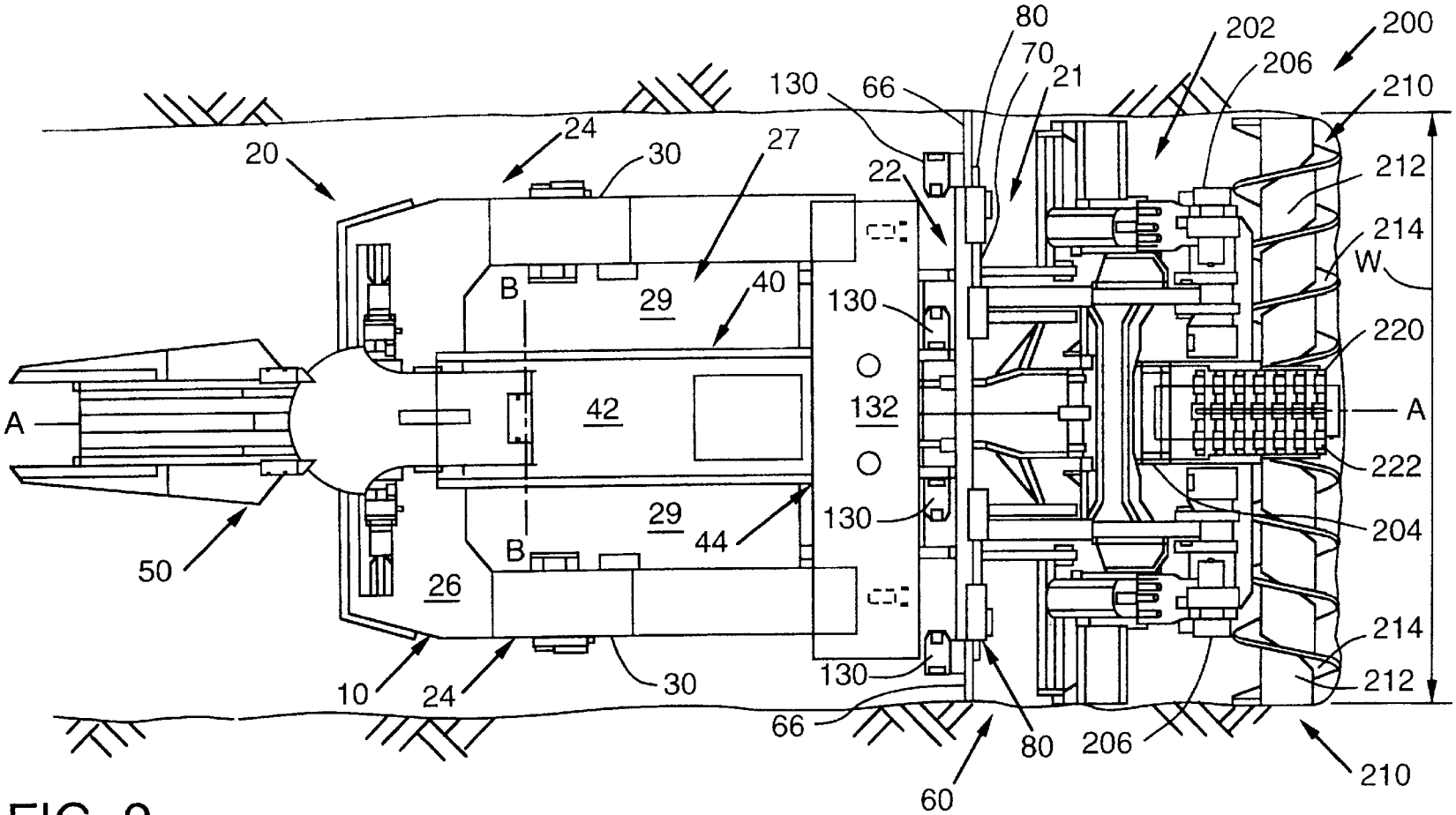
FIG. 2 is a plan view of the mining machine of FIG. 1.
Figure 3:
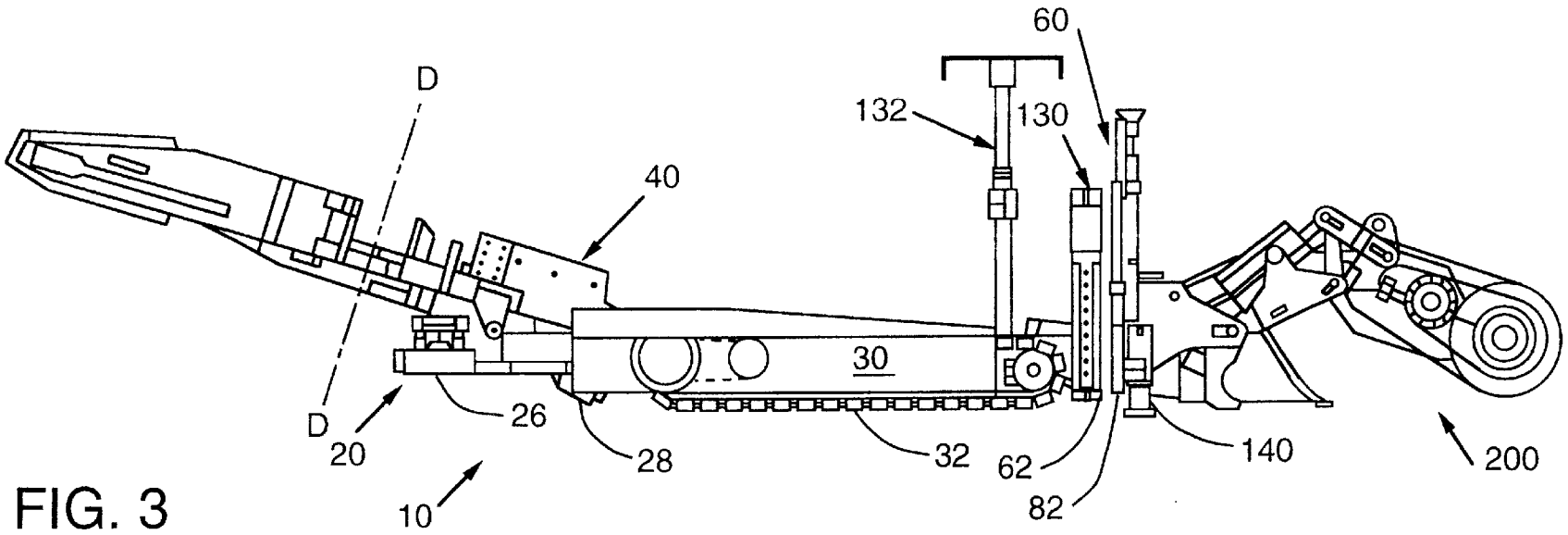
FIG. 3 is a side clevational view of the mining machine of FIGS. 1 and 2.
Figure 4:
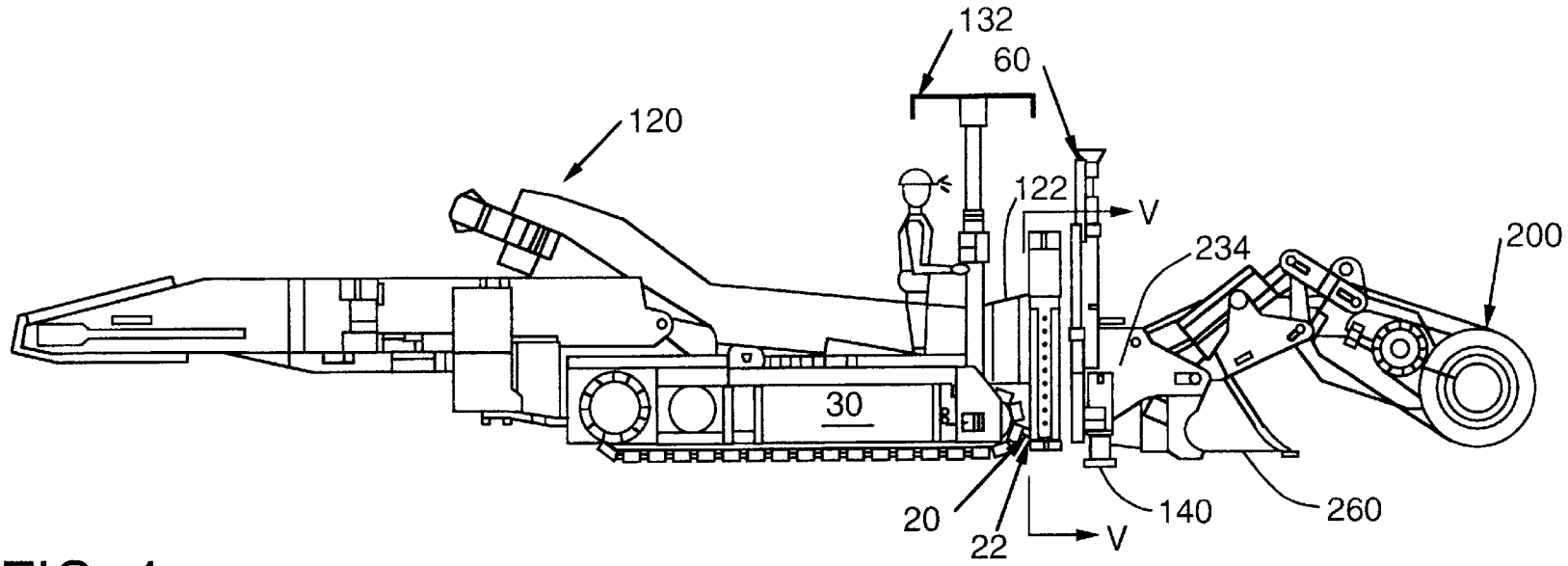
FIG. 4 is a side elevational view of the mining machine of FIGS. 1–3 with a ventilation duct assembly attached thereto.

Referring now to the drawings for the purposes of illustrating the present preferred embodiments of the invention only and not for the purposes of limiting the same, FIGS. 1–3 show a mining machine 10 of the present invention that has a detachable mining assembly 200 attached thereto. As can be seen in those Figures, the mining machine 10 may include a chassis 20 that has a forward portion 22, two side portions 24 and a rear portion 26. The rear portion 26 may be substantially U-shaped as shown in FIGS. 1 and 2. Also in one preferred embodiment, the side portions 24 are affixed to the forward portion 22 and cooperate with the forward portion 22 and the rear portion 26 to define an operator area 27 therebetween. Deck plates 29 are provided on the chassis 20 to enable machine operator(s) to safely walk within the confines of the machine 10 to control, operate and service various machine components. For higher operating heights, the operator area may be flush across the machine chassis 20.

The side portions 24 each comprise a propulsion assembly 30 that may include a conventional endless driven ground engaging track 32. However, other forms of propulsion generating apparatuses (e.g., driven wheels, walking pads, etc.) could be employed. The reader will further appreciate that the side portions 24 could comprise skid assemblies and the machine 10 could receive its forward and rearward propulsion through the application of appropriate forces on the chassis assembly 20 by independent propulsion and withdrawal apparatuses located remote from the mine face.

To convey the material that is dislodged or "won" from the seam by a mining assembly 200 attached to the forward portion 22 of the machine 10, a conveyor assembly 40 is employed. Such conveyor assemblies are generally well known in the mining art and, therefore, their construction and operation will not be discussed in great detail herein. As can be seen in FIGS. 1 and 2, the conveying assembly 40 may comprise an elongated conveyor trough 42 that has a front end portion 44 that is supported adjacent the forward portion 22 of the chassis 20. In the embodiment depicted in FIGS. 1–3, a conventional conveyor "tailpiece" 50 is pivotally attached to the trough 42 in a known manner. The skilled artisan will appreciate that the tailpiece 50 may be selectively pivoted about a transverse axis B—B and is also equipped with a discharge portion 52 that can be pivoted about a vertical axis D—D in known manners. See FIG. 3. An endless conveyor member (not shown), which may comprise a conventional conveyor belt or conveyor chair, is operably supported within the trough 42 and the tailpiece 50. The conveyor belt or chain is driven in an orbit such that won material entering the front portion of the trough 42 is conveyed to the tailpiece 50 for discharge therefrom. Those of ordinary skill in the art will appreciate that other conveyor arrangements may also be successfully employed.

Figure 5:
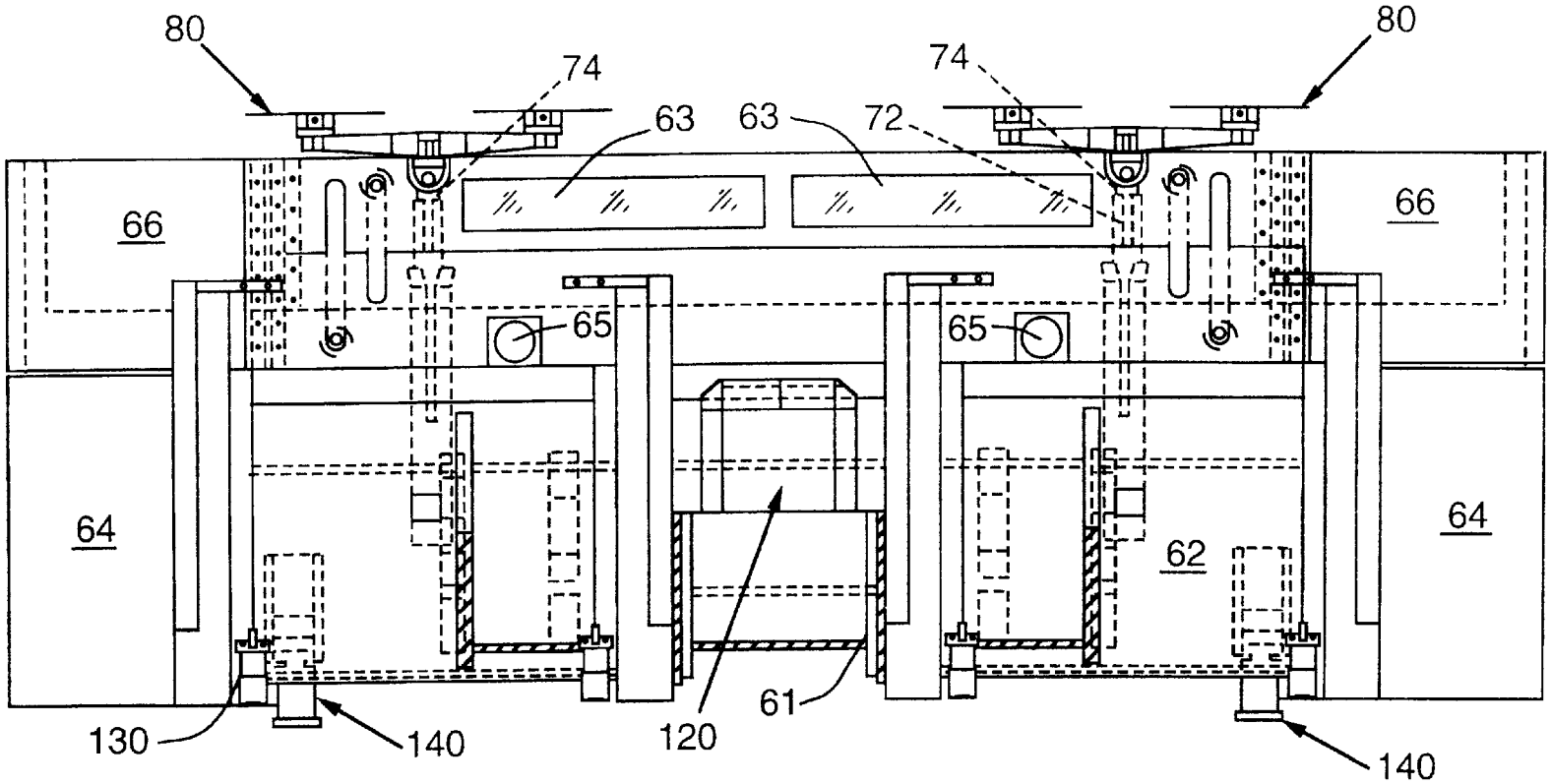
FIG. 5 is a cross-sectional view of the mining machine of FIG. 4 taken along line V—V in FIG. 4.
Figure 6:
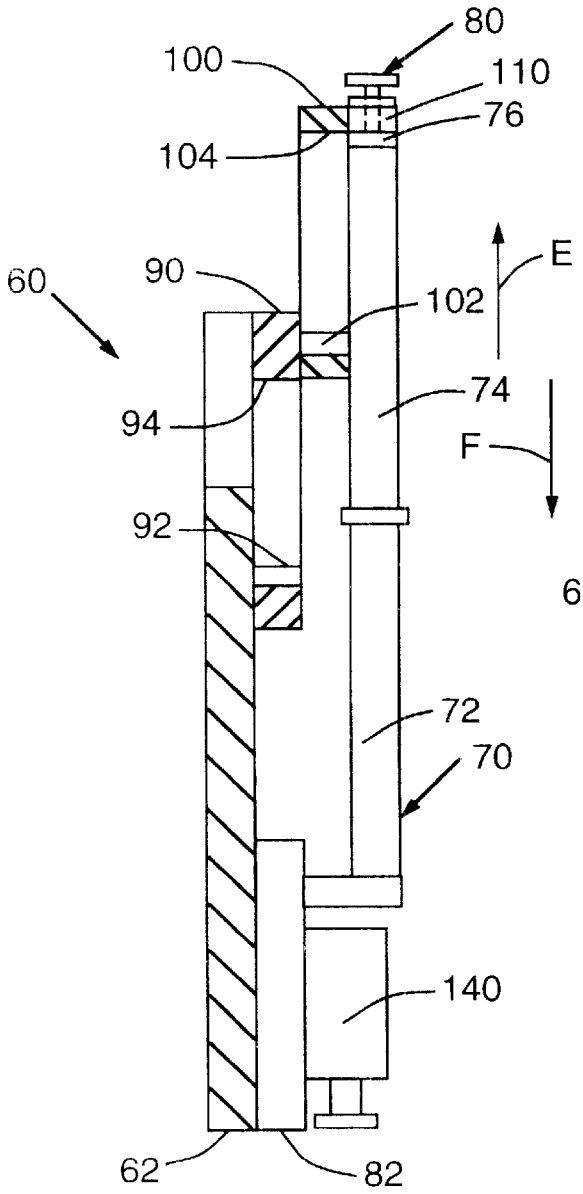
FIG. 6 is a partial cross-sectional view of an extendable and retractable shield of the present invention in a fully extended position.
Figure 7:
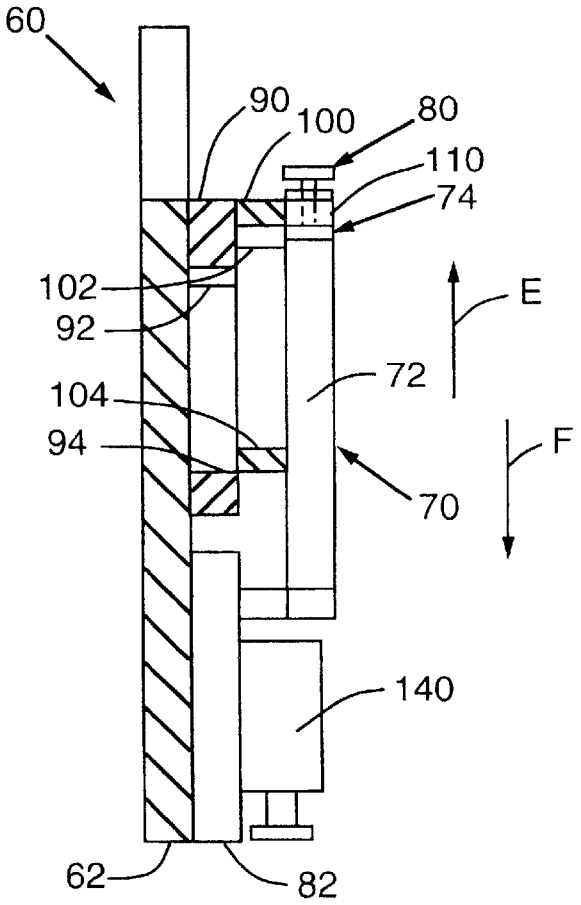
FIG. 7 is a partial cross-sectional view of the shield of FIG. 7 in a fully retracted position.

As can be seen in FIGS. 1–7, this embodiment of the present invention also includes a vertically extending shield assembly 60 that serves to protect operator(s) located in the operator area 27 from flying debris generated by the mining assembly that is attached to the forward portion 22 of the chassis 20. Such shield assembly 60 preferably spans the entire width "W" of the mining assembly 200 and, therefore, has a width that is substantially equal to the width of the entry to effectively prevent flying debris from entering the operator area 27 of the machine 10 during mining. The shield assembly 60 may include a first vertically extending plate 62 that is rigidly affixed to the forward portion 22 of the chassis 20 or that comprises an integral portion of the chassis 20. Side shield plates (64, 66) may also be attached to the chassis and oriented as shown in FIG. 5. The mining machine 10 may also be equipped with a pair of conventional hydraulically-actuated "temporary" roof support cylinders 70. The construction and operation of such roof support cylinders 70 are known in the art. Each cylinder 70 has a body portion 72 that movably supports a first piston 74 therein. A second piston 76 is coaxially supported within the first piston 74. Those of ordinary skill in the art will appreciate that the first piston 74 is slidably housed within the body 72 such that it can be selectively extended therefrom and retracted therein The second piston 76 is slidably housed within the first piston 74 and may be selectively extended therefrom and retracted therein. Attached to the end of the second piston 76 is a roof support assembly 80 that is adapted to be brought into engagement with the entry roof by extending the first and second pistons (74, 76). As can be seen in FIGS. 1, 6 and 7, each cylinder body 72 is rigidly attached to a mounting plate 82 that is attached to the first plate 62 or is otherwise affixed to the forward portion 22 of the chassis 20.

FIGS. 6 and 7 are graphical depictions of a preferred shield assembly 60 of the present invention, As can be seen in those Figures, the shield assembly 60 further comprises a first shield plate 90 and a second shield plate 100. The first shield plate 90 is slidably mounted to the plate 62 by a pair of retaining pins 92 that are attached to plate 62 and are received in corresponding slots 94 in the first shield plate 90. Such arrangement permits the first shield plate 90 to slide relative to the plate 62 in directions represented by arrows "E" and "F". Similarly, the second shield plate 100 is slidably attached to the first shield plate 90 by a pair of second pins 102 that are attached to the first shield plate 90 and are received in corresponding second slots 104 in the second shield plate 100. Such arrangement permits the second shield plate 100 to slide relative to the first shield plate 90 in directions "E" and "F".

In this embodiment, the shield plates (90, 100) are selectively slidably positioned relative to each other by the temporary roof support cylinders 70. However, other conventional cylinder arrangements may also be employed. To facilitate such slidable travel and to enable the second pistons 76 bring their respective roof assemblies 80 into contact with the entry roof, each second piston 76 is slidably supported by a corresponding support bearing 110 that is attached to the second shield plate 100. It will be appreciated that the second piston 76 may slidably pass through the corresponding support bearing 110 as the second piston 76 is extended and retracted. To extend the shield plates (90, 100) upward toward the entry roof, the first pistons 74 are each extended to bring them into contact with the corresponding support beatings 110 to cause the second shield plate 100 to slide in the "E" direction. The first shield plate 90 will not move vertically until the bottom of each slot 104 contacts the corresponding pin 92. Continued movement of the first piston 74 and the second shield plate 100 will also cause the first shield plate 90 to slide vertically in the "E" direction until the bottom of the slots 94 contact the corresponding pins 92 therein. See FIG. 6. Thus, in this position the shield assembly 60 is fully extended. The skilled artisan will appreciate that each second piston 76 may also be extended into the "E" direction to bring their corresponding roof support assemblies 80 into contact with the entry roof. To retract the shield assembly 60, the second piston 76 is retracted into the first piston 74 and the first piston 74 is retracted into the cylinder body 72 in the "F" direction. See FIG. 7. As can be seen in FIGS. 5–7, the plate 62 may preferably not extend as high as the side shield plates 66, such that when the shield plate assembly is in the retracted position (FIG. 7), the operator(s) can view the mining apparatus 200 from the operator area 27. Those of ordinary skill in the art will readily appreciate that the shield 60 may be fabricated from any suitable number of extendable and retractable shied plates. For example, the shield assembly may comprise three extendable and retractable plates.

The skilled artisan will appreciate that the conveyor assembly 40 extends through an opening 61 in the shield assembly 60 such that the material won by the mining assembly 200 can enter the conveyor assembly 40. See FIG. 5. Also in this embodiment, a ventilation duct assembly 120 may be supported on the mining machine 10 and have a first end 122 that is attached to the plate 62 adjacent the conveyor opening 61 to draw dust, methane gas etc. therein and away from the operator(s) on the machine. The duct assembly 120 may include a conventional ventilation fan 124 that serves to draw the dust and gases into and through the duct assembly 120. The duct assembly 120 may be interconnected with a dedicated ventilation system (not shown) located within the entry or it may discharge the dust and gas at the rear of the machine away from the operator(s). The mining machine 10 may also be equipped with bolting assemblies 130 for installing retaining bolts into the roof and ribs of the entry. Also, a roof support cylinder arrangement 132 that includes a roof shield 134 may be mounted the chassis 20 to provide the operator(s) with additional protection from falling debris.

In a preferred embodiment, the shield plates (62, 82, 90, 100) are fabricated from steel and may be covered with rubber or composite belting or have an extension of rubber or composite belting material attached thereto if desired. Those of ordinary skill in the art will appreciate that the shield assembly 60 protects the operator(s) from material that may be thrown from the mining assembly 200 during mining. The shield assembly 60 may also provide a mounting structure for mounting the temporary roof support cylinder 70. In addition, conventional hydraulically-operated floor cylinders 140 may also be attached to the shield assembly 60. Such floor support cylinders 140 are known in the art and can be used to level and stabilize the mining machine 10 and work in concert with the temporary roof support cylinders 70 to support the entry roof during mining and prior to bolting. The shield assembly 60 of the present invention also substantially maintains the dust that is generated by the cutting process and methane and other gases generated by the mining process at the working face of the seam and away from the operators. The ductwork assembly 120 of the present invention can be advantageously used to isolate such dust and gases from the operators and move them away from the operator area. If desired, sensing devices (not shown) can be mounted on the shield assembly 60 or ductwork assembly 120 to provide continuous monitoring of the environment at the working face. Lights, water sprays and ventilation control ports and fans (not shown) may also be mounted to and/or through the shield assembly 60.

As can be seen in FIG. 5, high impact resistant windows 63 may be installed in the shield assembly 60 to permit visual monitoring of the mining assembly and to evaluate the condition of the working face. In addition, video cameras 65 housed within impact and moisture resistant housings may be mounted to the shield assembly for monitoring purposes. Those of ordinary skill in the art will also appreciate that the shield assembly 60 may alternatively be constructed from steel frame members and plates to form an integral duct system therein to ventilate harmful dust and gases away from the operator(s).

Figure 7A:
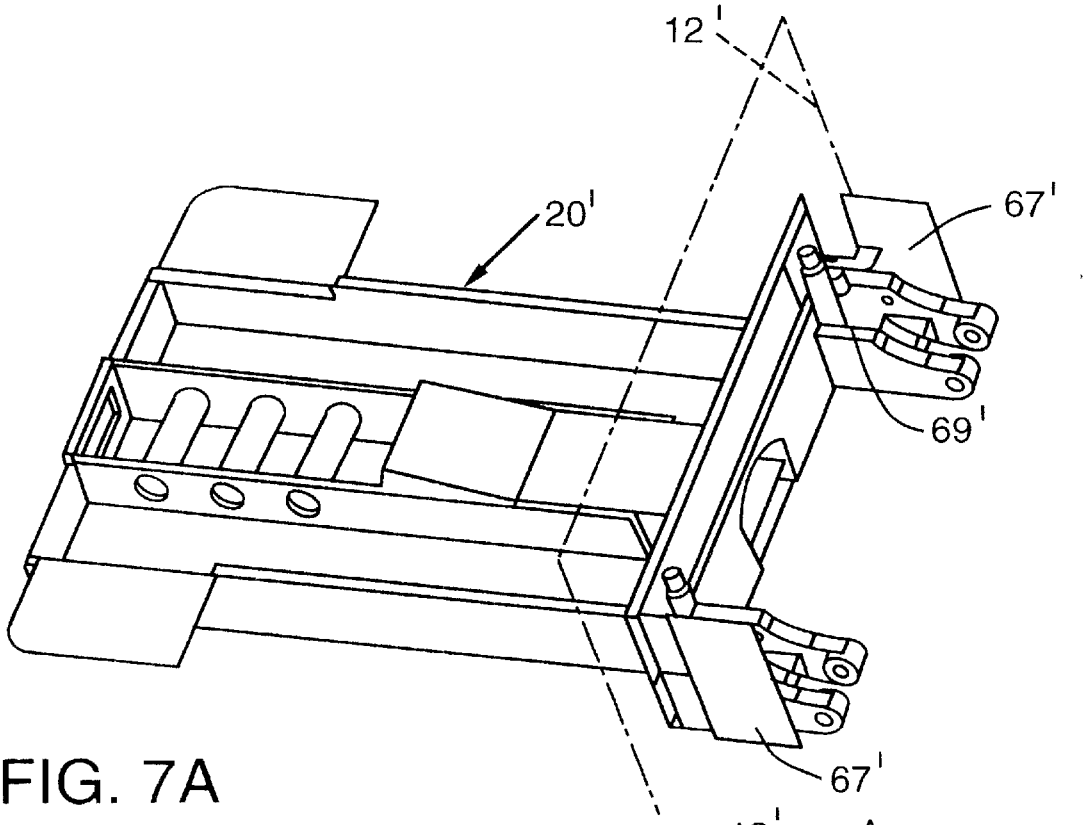
FIG. 7A is a perspective view of a chassis of another preferred embodiment of the present invention having selectively extendable lateral shield members thereon with the shield members pivoted to positions adjacent the lateral sides of the chassis.
Figure 7B:
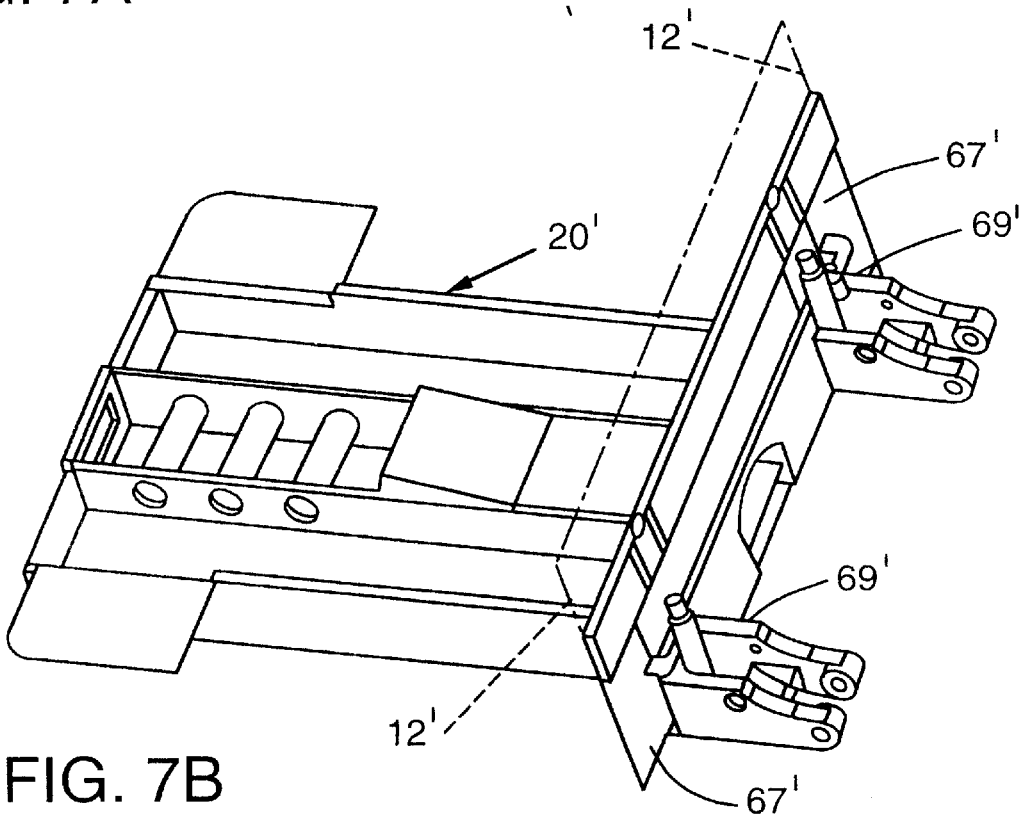
FIG. 7B is another view of the embodiment depicted in FIG. 7A with the lateral shield members pivoted into engagement with the side walls of an entry (represented by dotted lines)

In another preferred embodiment as shown in FIGS. 7A and 7B, a laterally extending plate 67' is pivotally attached to each lateral side 24' of the machine chassis 20'. Each laterally extending plate 67' is selectively pivotable relative to the chassis 20', by a corresponding rotary cylinder 69'. However, other hydraulically actuated cylinder arrangement could be employed to selectively pivot each laterally extending shield plate 67' to a position shown in FIG. 7B, such that a seal may be established between the side wall of the entry (represented by lines 12' in FIGS. 7A and B) and the corresponding laterally extending plate 67'.

Figure 8:
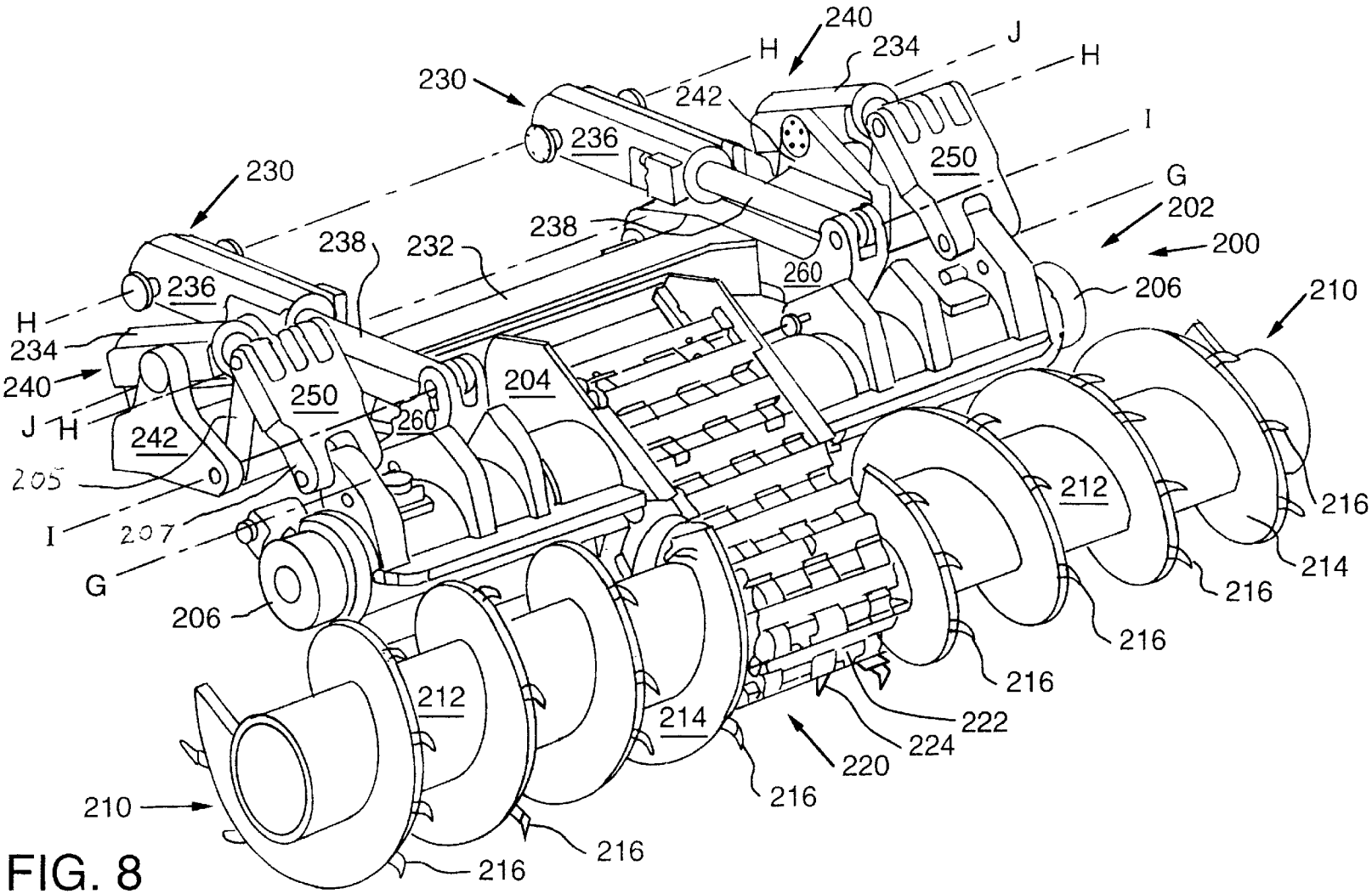
FIG. 8 is partial front perspective view of a detachable mining assembly of the present invention.
Figure 9:
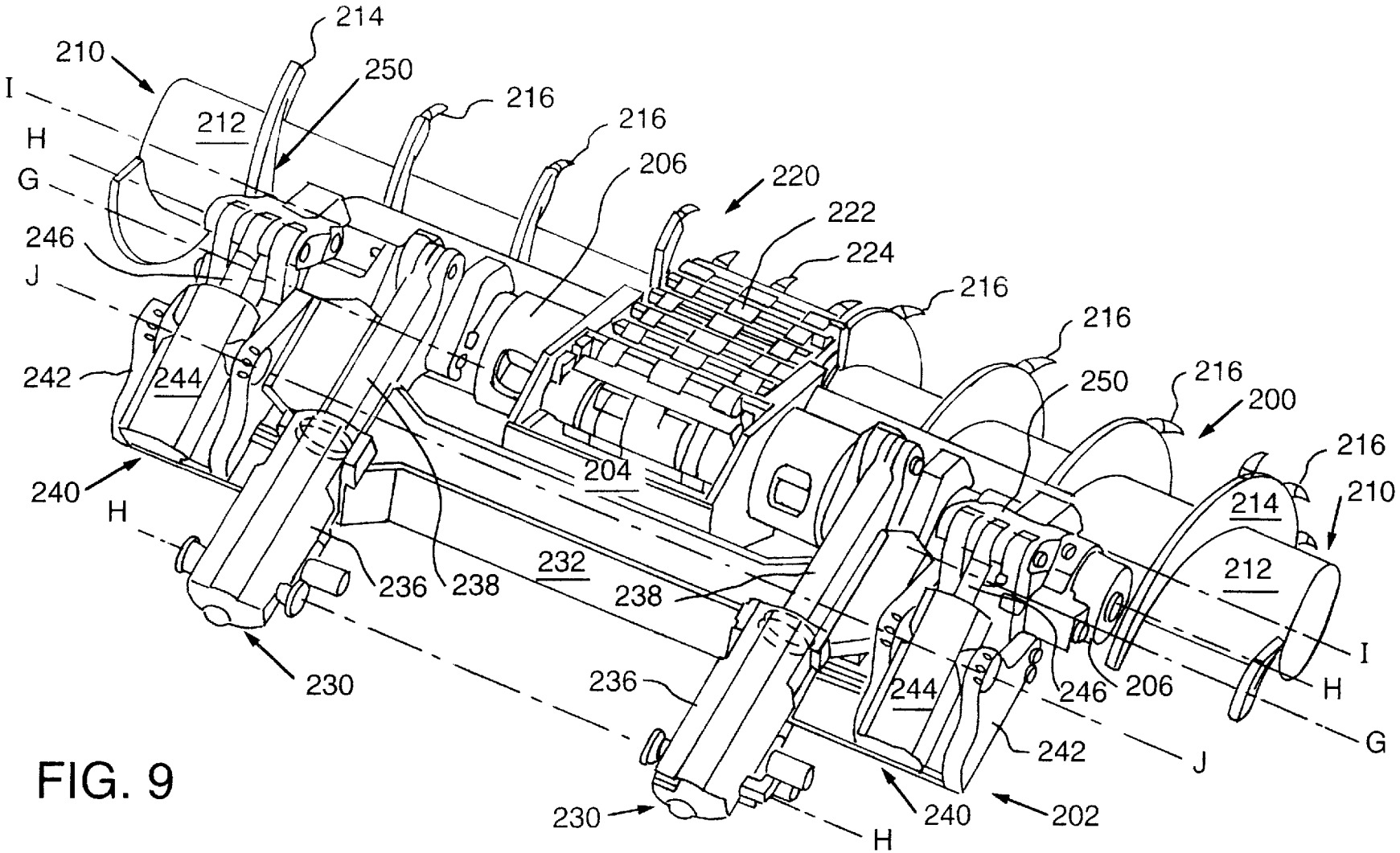
FIG. 9 is a partial rear perspective view of the mining assembly of FIG. 8.
Figure 9A:
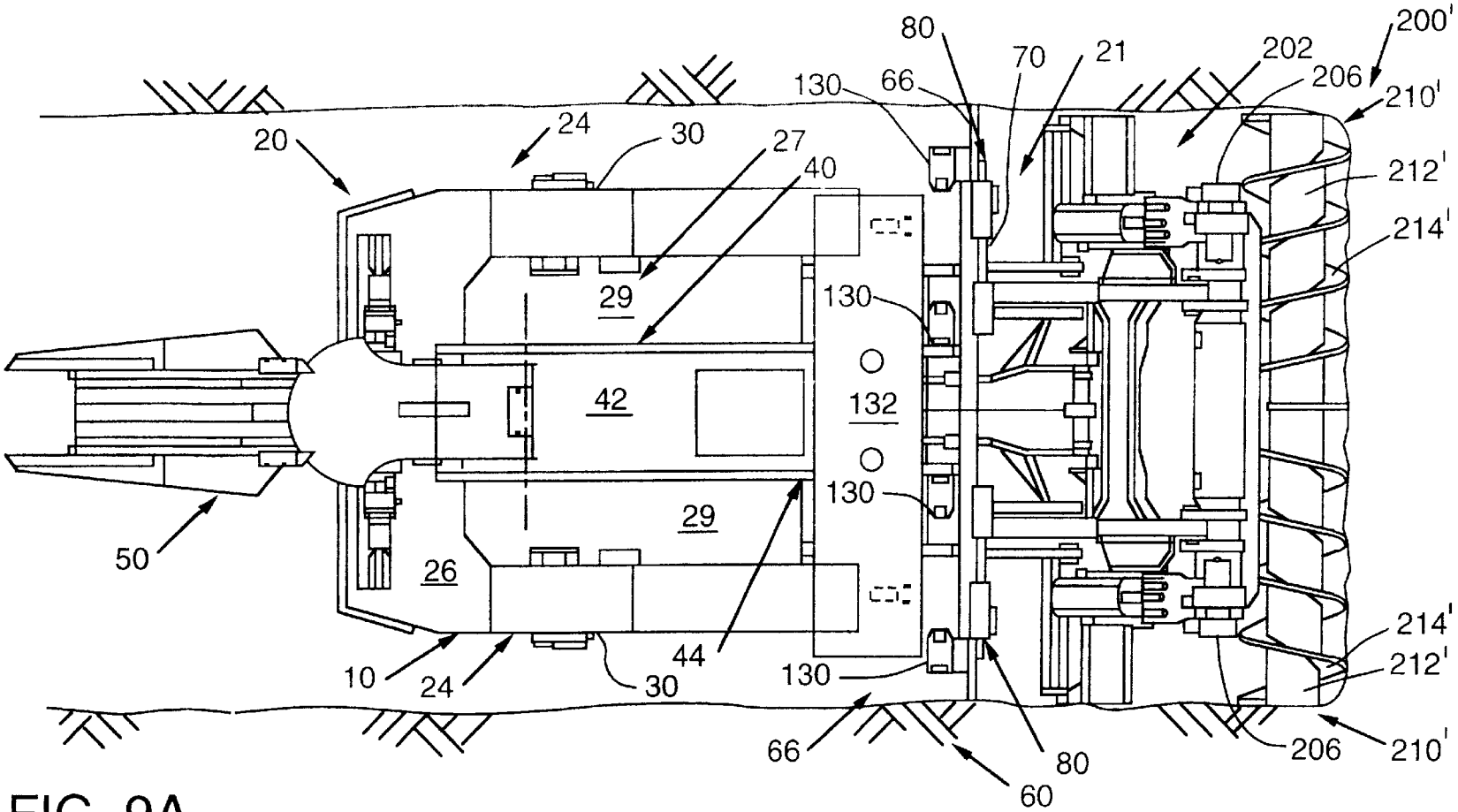
FIG. 9A is a plan view of another preferred embodiment of the present invention.

The present invention may also include a detachable mining assembly 200 that is affixed to the forward portion 22 of the chassis 20. The mining assembly 200 may include a support frame 202. Two outwardly protruding support arms 206 are attached to the central section 204 and protrude outwardly therefrom as shown in FIGS. 8 and 9. Support within the forward portion of the central section 204 is a conventional motor (not shown) that serves to rotatably drive two cutting drums 210 attached thereto that combine to extend across the entire face 21 of the mining machine 10. As can be seen in FIG. 1, the mining assembly 200 has a width that is greater than the width of the chassis 20 of the mining machine 10. Each cutting drum 210 may comprise a generally cylindrical support member 212 that has a helical member 214 thereon. A plurality of conventional mining bits 216 are attached to the helical is members 214. An endless conveyor/mining assembly 220 may be disposed within the central section 204 and is driven in an orbit therein by the cutting drums 210. The conveyor/mining assembly 220 may comprise an endless chain/link conveyor 222 that has a plurality of mining bits 224 attached thereto. Those of ordinary skill in the art will appreciate that, as the mining assembly 200 is advanced into the seam, the mining bits 216 on the helical members 214 and the mining bits 224 on the conveyor/mining assembly 220 dislodge material from the seam The helical members 214 direct the material that is dislodged by the cutting drums 210 towards the center of the mining assembly 200 wherein it is directed rearwardly by mining assembly 200 such that it can pass through the opening 61 in the shield assembly 60 and onto the conveyor assembly 40. As can be seen in FIG. 9A, the mining assembly 200' may comprise a "solid" cutting head 210' that has a cylindrical support member 212' and helical members 214' thereon. A plurality of conventional mining bits 216' are attached to the helical members 214'. The helical members 214' serve to direct the won material toward the center of the cutting head 210' wherein it can enter the conveying member.

To further direct the won material through the opening 61 and onto the conveying assembly 40, a blade member 260 is attached to the support frame 202 as shown in FIGS. 1–3. Blade member 260 is shaped to interact with the mining assembly 200 and contain the won material allowing the cutting drums 210 to move the material to the conveyor inlet 61. Blade member 260 contains the won material in front of it until the material is moved to opening 61, hence acting as a floor cleaning (dozer) blade. Those of ordinary skill in the art will also appreciate that the blade member 260 may be fabricated such that it can be selectively extended such that it is at least as long (laterally) as the cutting mechanism employed.

The mining assembly 200 may be selectively pivoted about various axes by a collection of hydraulic cylinders. More particularly and with reference to FIGS. 8 and 9, a support brace 232 is pivotally attached to the support frame 202 such that the support frame can be selectively pivoted relative to the support brace 232 about a first axis G—G. See FIG. 8. A pair of first hydraulic cylinders 230 are pivotally attached to the chassis 220 or to the shield assembly 60 by a pair of mounting blocks 234 that are attached to the shield assembly 60 or chassis 20. Such cylinders are attached to the mounting blocks 234 in a known manner such that the bodies 236 of the cylinders 230 can selectively pivot relative to the mining machine chassis 20 about a first intermediate axis H—H. The pistons 238 of the cylinders 230 are also pivotally attached to the rear support brace 232 such that the ends of the pistons 238 may pivot relative to the rear support brace 232 about a second intermediate axis I—I. Those of ordinary skill in the art will appreciate that by extending and retracting the pistons 238, the support frame 202 can be selectively pivoted about the first axis G—G.

As can also be seen in FIGS. 8 and 9, a pair of second hydraulically actuated cylinders 240 are pivotally attached to mounting assemblies 242 that are attached to the rear support brace 232 such that the bodies 244 of the cylinders 240 can pivot relative to the rear support brace 232 about a third intermediate axis J—J. The piston 246 of each first cylinder 240 is pivotally affixed to a corresponding first linkage assembly 250 that is configured as shown in FIGS. 8 and 9. Each first linkage assembly 250 includes a first link 207 is, in turn, pivotally pinned to a corresponding mounting arm 206 such that by extending and retracting the pistons 246, the support frame 202 is selectively pivoted about the first axis G—G. A support link 205 is pivotally connected at one end to the rear support brace or support member 232, and pivotally attached at its other end to the first link 207 and the end of the piston 246. Thus, by actuating the first cylinders 230, the first pivot axis G—G can be selectively positioned relative to the mining machine chassis 20. The second cylinders 240 can be employed to selectively pivot the support frame 202 about that first axis G—G. The skilled artisan will appreciate that such construction enables the cutting drums 210 to be advanced forwardly into the seam and also moved vertically up and down relative to the mining machine 10.

Figure 10:
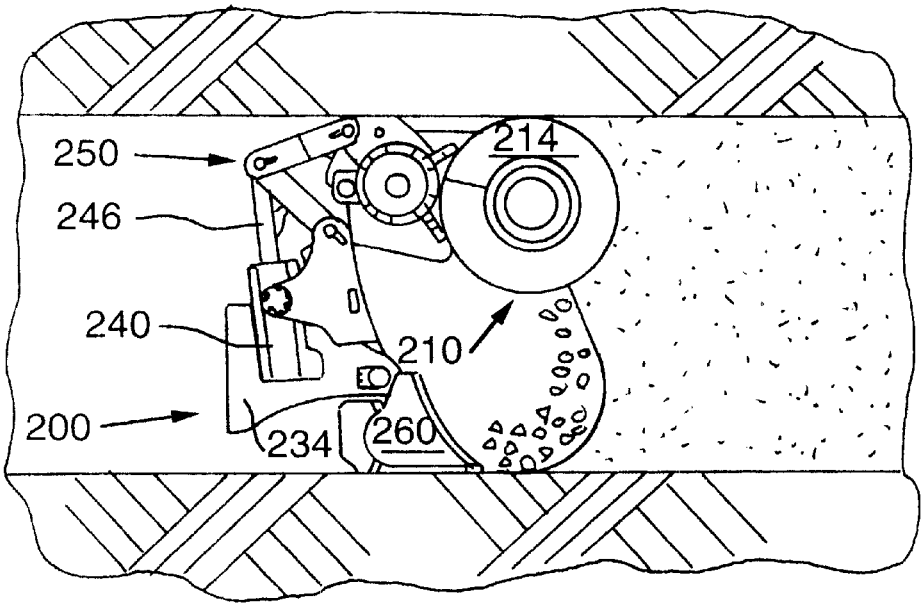
FIG. 10 is a partial side elevational view of a preferred mining assembly (with the mining machine omitted for clarity) and showing the cutting assembly in a first cutting position.
Figure 11:
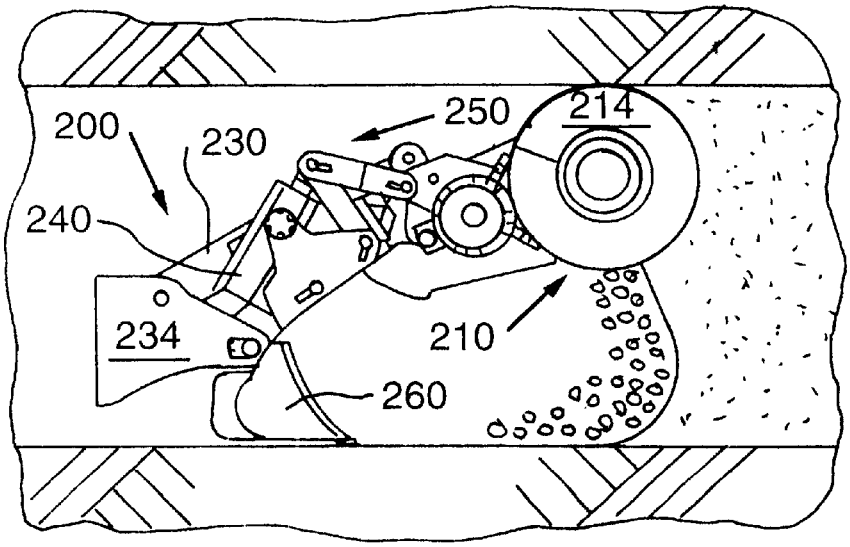
FIG. 11 is another partial elevational view of the apparatus of FIG. 10 with the mining assembly in the upper position of a final cutting movement.
Figure 12:
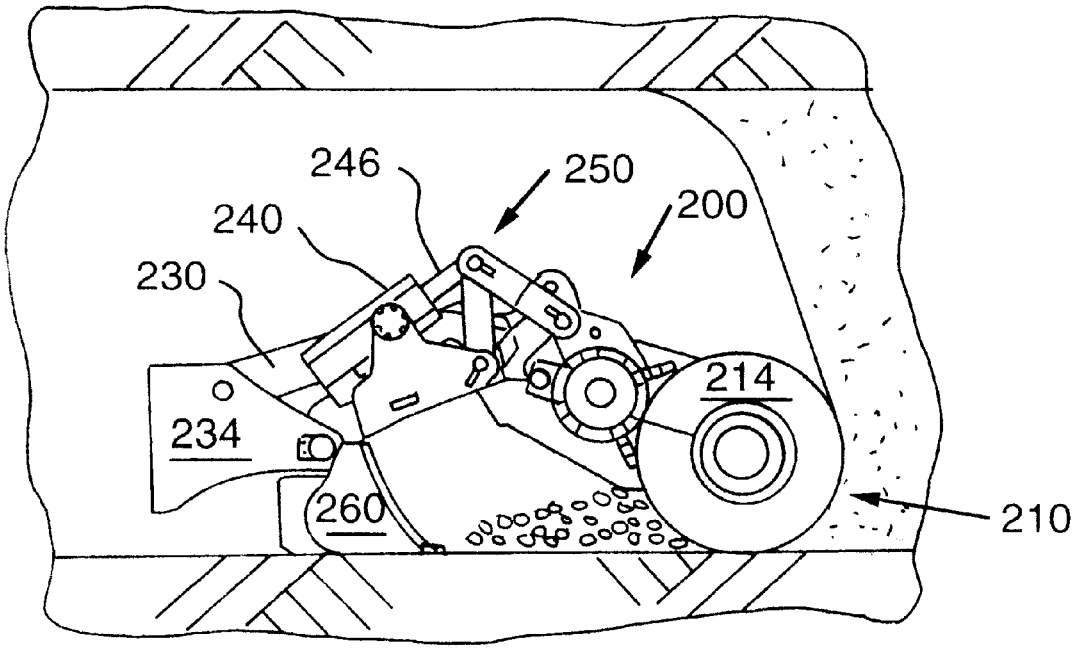
FIG. 12 is another partial elevational view of the apparatus of FIGS. 10 and 11 with the mining assembly thereof in the lower position of a final cutting movement.
Figure 13:
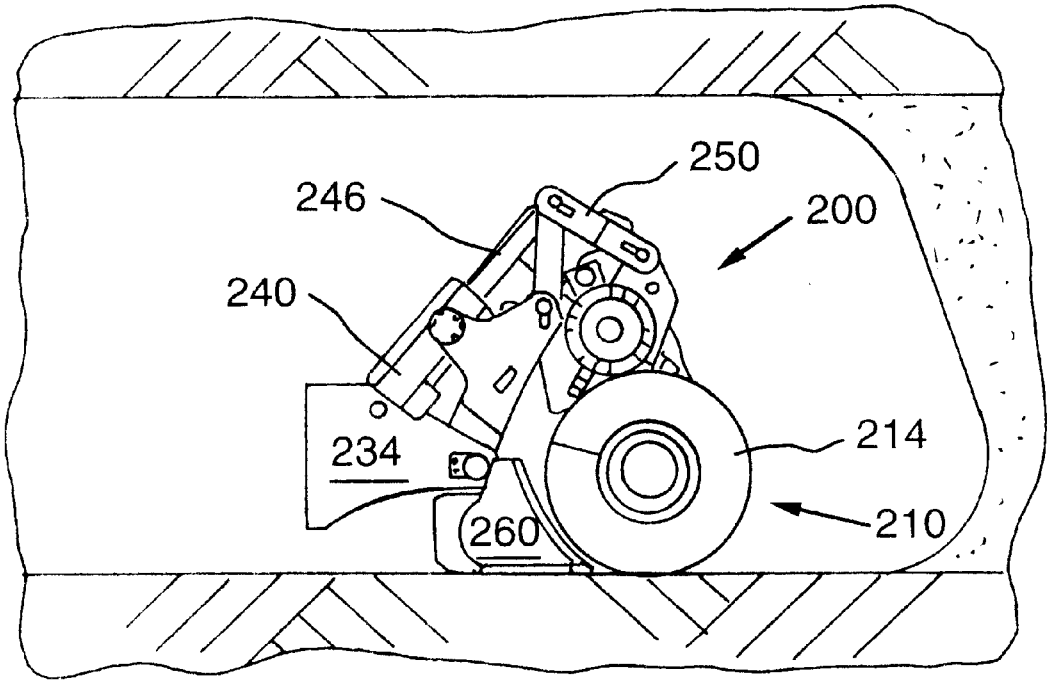
FIG. 13 is a partial side elevational view of the apparatus of FIGS. 10–12, with the mining assembly thereof in a rearmost position after raking the mined material back toward the mining machine.

The mining machine 10 is preferably advanced into a seam in a series of forwardly advancing moves. That is, the mining machine 10 initially mines as far, or less, as the mining assembly 220 can reach, then the machine 10 will be advanced forward to a position adjacent the seam face. The operation of the raining assembly 200 can be understood by reference to FIGS. 10–13. FIG. 10 depicts the mining assembly 200 in a "first cut" position wherein the machine 10 is positioned adjacent to the seam face such that the cutting drums 210 can be brought into engagement therewith As the mining bits 216 contact the material, it is dislodged from the seam and falls to the entry floor. The mining assembly 200 is pivoted in an arcuate path by the first and second cylinders (230, 240) through the seam and the assembly 200 is used to "rake" the won material back toward a guide member 260 that is attached to the support frame 202. As the material accumulates near the front portion 22 of the machine 10, it eventually enters the opening in the shield assembly 260 to be received on the conveying assembly 40. That process is repeated, without advancing the mining machine 10 until the mining assembly 200 can no longer be brought into engagement with the seam face. After the mining assembly 200 has been raked back as shown in FIG. 13, the mining machine 10 is advanced forward to a position adjacent the seam face and the process is repeated. Those of ordinary skill in the art will appreciate that because the cutting mechanism or assembly 200 extends across the entire face of the machine 10 and is movable forward and down across the surface to be mined, a relatively square entry is produced. Such square entry serves to permit better bolting. The reader will further appreciate, however, that while the mining assembly 200 provides advantages over prior cutting mechanisms, other cutting mechanisms could be employed. For example, a mining assembly that employs rotating cutting drums whose axes are supported substantially perpendicular to the mine face may also be employed and detachably affixed to the mining machine chassis utilizing the quick disconnect assembly 300 of the present invention.

Figure 14:
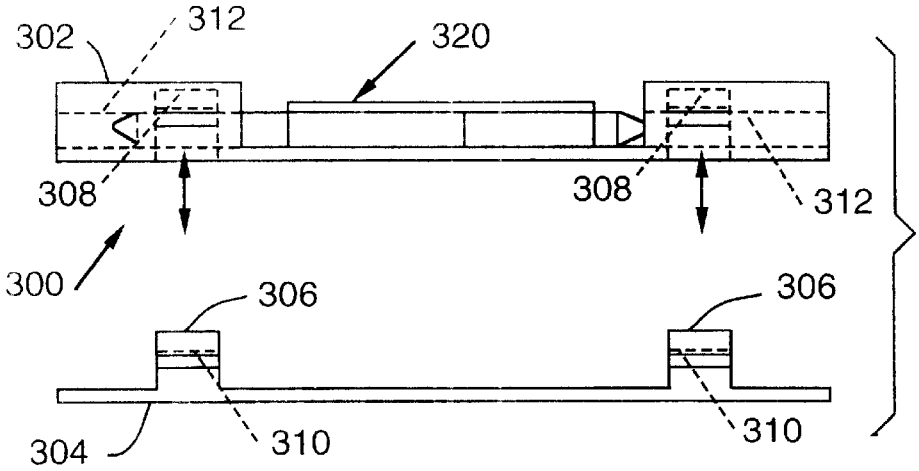
FIG. 14 is an exploded assembly view of a quick disconnect assembly of the present invention for attaching a mining assembly to a mining machine.
Figure 15:
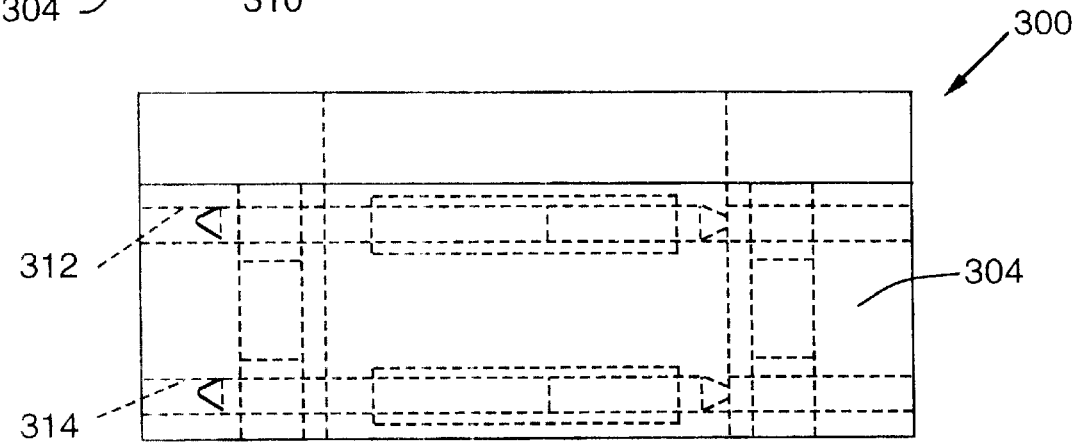
FIG. 15 is a front elevational view of a preferred quick disconnect assembly of FIG. 14.
Figure 16:
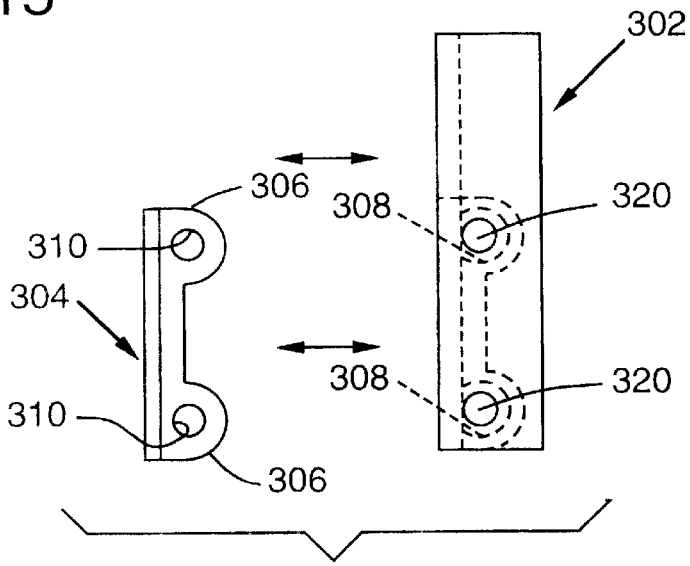
FIG. 16 is an exploded side elevational assembly view of the quick disconnect assembly of FIGS. 14 and 15.
Figure 17:
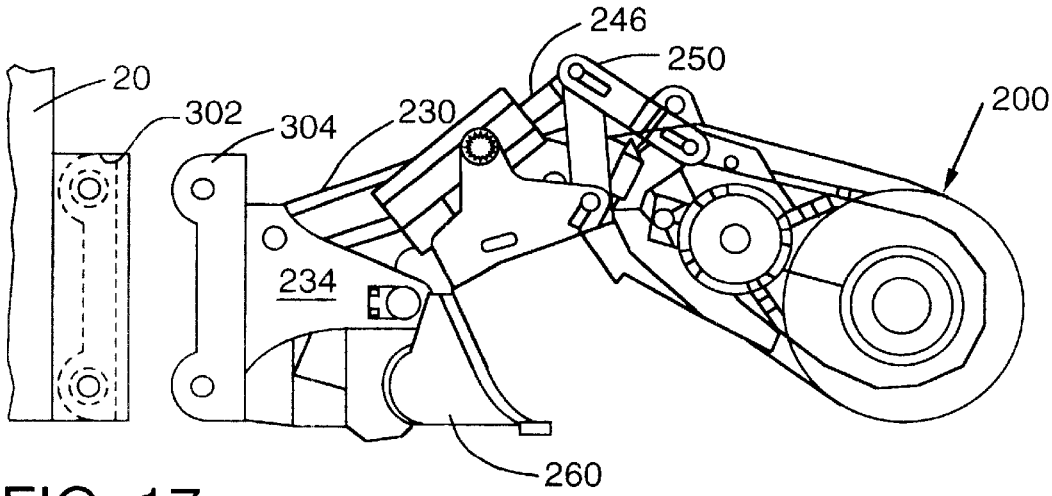
FIG. 17 is a partial exploded assembly view of a quick disconnect assembly of the present invention attached to a mining assembly of the present invention.
Figure 18:
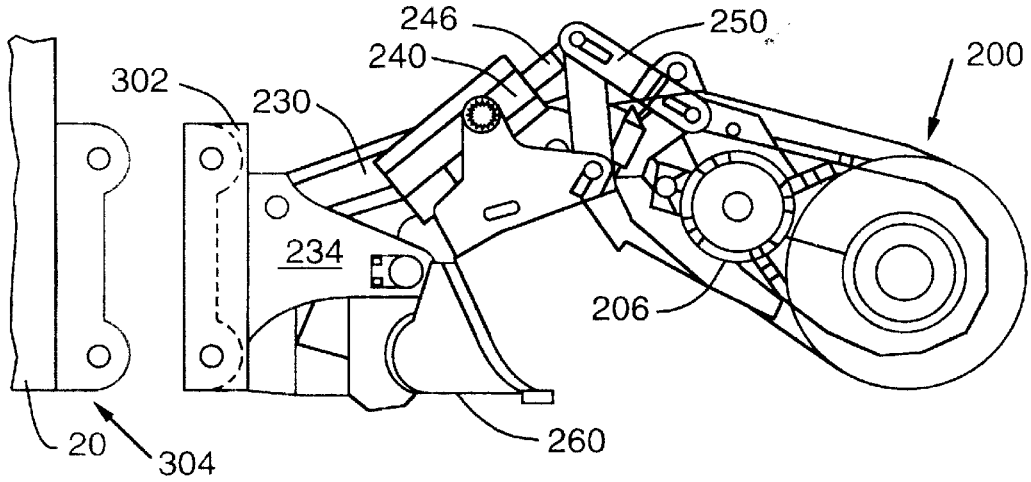
FIG. 18 is another partial exploded assembly view of a quick disconnect assembly of the present invention in a second orientation and attached to a mining assembly of the present invention.

As can be seen in FIGS. 14–16, a quick disconnect assembly 300 of the present invention may include a shield connector 302 that is adapted to be non-removably affixed to the front portion 22 of the chassis 20 or shield assembly 60. The skilled artisan will also appreciate that the shield connector 302 may also comprise an integral part of the chassis 20. The quick disconnect assembly 300 may also include a universal attachment plate 304 that is adapted to be attached to the mining assembly 200. A pair of attachment lugs 306 protrude outwardly from the rear side of the attachment plate 304 and are sized to be received in corresponding cavities 308 provided in the shield connector 304. Each lug 306 has a hole 310 extending therethrough that is adapted to be coaxially aligned with corresponding holes (312, 314) in the shield connector when the lugs 306 are received in their corresponding cavities 308. To selectively retain the lugs 306 in cavities 308 and thus affix the mining assembly 200 to the vehicle 10, a locking pin assembly 320 is employed. Locking pin assembly 320 preferably consists of pistons that are controlled by operator controlled hydraulic pressure. FIG. 17 is an exploded assembly view showing the quick disconnect assembly 300 of the present invention employed to attach a mining assembly 200 of the present invention to the mining machine 10. FIG. 18 is another exploded assembly view of the quick disconnect assembly 300 of the present invention with the universal attachment plate attached to the mining machine chassis 20 and the connector portion 302 attached to the mining assembly 200. Those of ordinary skill in the art will readily appreciate that the lugs 306 could alternatively be formed on the rear of the apparatus to be attached to the shield assembly 60 to avoid the necessity of an attachment plate. The reader will understand that when the quick disconnect assembly 300 is employed to attach hydraulically and/or electrically actuated apparatus to the vehicle, conventional quick disconnect hose connectors and electrical connectors can be employed to facilitate easy connection of the hydraulic supply lines and electrical cables to the apparatus. It will be further appreciated that present quick disconnect assembly can be successfully used to attached a variety of different attachments such as, for example, various sizes and designs of cutting mechanisms, feeder breakers, surge and feed hoppers, etc. to various types of chassis, etc.

Thus, from the foregoing discussion, it is apparent that the present invention provides many advantages over prior mining machine constructions. The ability for an operator to move about within the protected confines of the machine greatly improves operator safety when operating and servicing the machine. Furthermore, the unique design and reach of the present mining assembly along with its ability to be easily attached to and removed from a vehicle provides additional capabilities not offered by other mining apparatuses. In particular, the unique "twin-linkage" design of the present mining assembly enables the cutting mechanism to be moved forward, up or down and back. The subject cutting mechanism can also be retracted along the cut mine floor to assist in directing the won material to a location wherein it can be conveyed therefrom. In addition, the unique quick disconnect assembly not only makes it easy to quickly attach and detach the mining assembly to the chassis, it can be advantageously used to attached and detach a variety of components/accessories to various chassis and other apparatuses. It wall be further appreciated that one of the methods of attaching the quick disconnect assembly does not employ sliding mechanisms which can become fouled with dust, etc. which can hamper its operation. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A mining machine, comprising:

a chassis;

a cutting mechanism; and an actuation assembly affixed to said chassis and said cutting mechanism for selectively moving said cutting mechanism forward of said chassis, down across a surface to be mined and rearwardly towards said chassis, said actuation assembly comprising:

a cutting member support frame operably supporting at least one cutting member thereon;

a support member pivotally attached to said cutting member support frame such that said cutting member support frame is selectively pivotable relative to said support member about a first axis;

a first actuator attached to said support member and said mining machine chassis for selectively positioning said first axis relative to said mining machine chassis in a predetermined position; and a first linkage assembly comprising a first link having one end pivotally attached to the cutting member support frame, and another end pivotally connected to a second actuator attached to said support member, and a support link having one end pivotally attached to the support member, and another end pivotally attached to the first link and the second actuator for selectively pivoting said cutting member support frame relative to said support member about said first axis.

2. The mining machine of claim 1 wherein said cutting mechanism comprises at least one rotating cutting drum;

at least one helical member attached to at least one said rotating cutting drum; and at least one cutting bit attached to at least one said helical member.

3. The mining machine of claim 1 wherein said cutting mechanism comprises:

a support frame attached to said actuation assembly;

an endless conveying member operably supported on said support frame and driven in an orbit thereon;

a first rotating cutting drum having a first helical member thereon, said first rotating cutting drum operably affixed to said support frame adjacent a first side of said endless conveying member; and a second rotating cutting drum having a second helical member thereon and being affixed to said support frame adjacent a second side of said endless conveying member.

4. The mining machine of claim 3 wherein said first helical member, said second helical member and said endless conveyor member each have at least one cutting bit attached thereto.

5. The mining apparatus of claim 1 wherein each said first actuator is detachably affixed to said mining machine chassis.

6. The mining machine of claim 1 wherein said cutting member support frame operably supports an endless conveying member thereon and wherein said cutting member comprises:

a first rotating cutting drum having a first helical member thereon, said first rotating cutting drum operably affixed to said cutting member support frame adjacent a first side of said endless conveying member; and a second rotating cutting drum having a second helical member thereon and being affixed to said cutting member support frame adjacent a second side of said endless conveying member.

7. The mining machine of claim 6 wherein said first helical member, said second helical member and said endless conveying member each have at least one cutting bit attached thereto.

8. The mining machine of claim 1 further comprising at least one bolter attached to said mining machine chassis.

9. The mining machine of claim 1 further comprising an attachment assembly attached to said chassis and said cutting mechanism to enable said cutting mechanism to be selectively detached from said chassis.

10. The mining machine of claim 9 wherein said attachment assembly comprises:

at least one attachment lug protruding from said cutting mechanism; and a locking member supported by said chassis for selective engagement with each said attachment lug to detachably affix said first linkage assembly to said chassis.

11. The mining machine of claim 9 wherein said attachment assembly comprises:

a first attachment plate attached to said cutting mechanism and having at least one attachment lug protruding therefrom, each attachment lug having a first hole extending therethrough;

a second attachment plate attached to said chassis and having receptacles corresponding to each said attachment lug for receiving said corresponding attachment lug therein;

a pair of coaxially aligned apertures through said second attachment plate adjacent said receptacles such that when each said attachment lug is received in said corresponding receptacle, the first hole through said attachment lug is coaxially aligned with said adjacent coaxially aligned apertures in said second attachment plate; and a retaining pin corresponding to each said pair of attachment lugs and being removably insertable into said coaxially aligned apertures in said second attachment plate and said coaxially aligned holes through said corresponding attachment lugs to removably affix said first attachment plate to said second attachment plate.

12. The mining machine of claim 9 wherein said attachment assembly comprises:

at least one attachment lug protruding from the chassis; and a locking member supported by said cutting mechanism for selective engagement with said attachment lugs to detachably affix said cutting mechanism to said chassis.

13. The mining machine of claim 12 further comprising:

a first attachment plate attached to said chassis and having an attachment lug protruding therefrom, each said attachment lug having a first hole therethrough;

a second attachment plate attached to said cutting mechanism and having receptacles corresponding to each said attachment lug for receiving said corresponding attachment lug therein;

a pair of coaxially aligned apertures through said second attachment plate adjacent said receptacles such that when each said attachment lug is received in said corresponding receptacle, the first hole through said attachment lug is coaxially aligned with said coaxially aligned apertures in said second attachment plate; and a retaining pin corresponding to each said pair of attachment lugs and being removably insertable into said coaxially aligned apertures in said second attachment plate and said coaxially aligned holes through said corresponding attachment lugs to removably affix said first attachment plate to said second attachment plate.

14. The mining machine of claim 1 wherein said chassis defines an operator area and wherein said mining machine further comprises a vertically extending shield attached to said chassis and located between said cutting mechanism and said operator area.

15. The mining machine of claim 14 wherein said vertically extending shield comprises:

a first upstanding shield member supported on said chassis;

a second upstanding shield member supported adjacent said first upstanding shield plate for selective vertical movement relative to said first shield member; and at least one extender affixed to said chassis and said second upstanding shield member, said extenders constructed to selectively extend and retract said second shield member vertically relative to said first shield member.

16. The mining machine of claim 14 wherein said chassis has two lateral sides and wherein said cutting mechanism cuts an entry having lateral side walls in the material to be mined and wherein said mining machine further comprises a selectively extendable lateral shield member attached to each said lateral side of said chassis for selective sealing engagement with a corresponding side wall of the entry.

17. The mining machine of claim 14 further comprising at least one viewing window in said vertically extending shield.

18. The mining machine of claim 14 further comprising at least one video camera attached to said vertically extending shield.

19. The mining machine of claim 1 wherein said second actuator is pivotally attached to said support member.

20. A detachable mining apparatus for selective attachment to a mining machine having a mining machine chassis, said detachable mining apparatus comprising:

a cutting mechanism; and an actuation assembly removably attachable to said chassis and said cutting mechanism for selectively moving said cutting mechanism forward of said chassis and down across a surface to be mined, said actuation assembly comprising:

a cutting member support frame operably supporting at least one cutting member thereon;

a support member pivotally attached to said cutting member support frame such that said cutting member support frame is selectively pivotable relative to said support member about a first axis;

a first actuator attached to said support member and said mining machine chassis for selectively positioning said first axis relative to said mining machine chassis in a predetermined position; and a first linkage assembly comprising a first link having one end pivotally attached to the cutting member support frame, and another end pivotally connected to a second actuator attached to said support member, and a support link having one end pivotally attached to the support member, and another end pivotally attached to the first link and the second actuator for selectively pivoting said cutting member support frame relative to said support member about said first axis.

21. The detachable mining apparatus of claim 20 wherein said cutting mechanism comprises at least one rotating cutting drum;

at least one helical member attached to at least one said rotating cutting drum; and at least one cutting bit attached to at least one said helical member.

22. The detachable mining apparatus of claim 20 wherein said cutting mechanism comprises:

a support frame attached to said actuation assembly;

an endless conveying member operably supported on said support frame and driven in an orbit thereon;

a first rotating cutting drum having a first helical member thereon, said first rotating cutting drum operably affixed to said support frame adjacent a first side of said endless conveying member; and a second rotating cutting drum having a second helical member thereon and being affixed to said support frame adjacent a second side of said endless conveying member.

23. The detachable mining apparatus of claim 22 wherein said first helical member, said second helical member and said endless conveyor member each have at least one cutting bit attached thereto.

* * * * *